United States Patent [19]

Kirkpatrick et al.

[11] 3,960,547

[45] June 1, 1976

[54] STEELMAKING PROCESS

[75] Inventors: James W. Kirkpatrick, Poland Township, Mahoning County; W. Fergus Porter, Poland; William E. Shepherd, Youngstown, all of Ohio

[73] Assignee: Youngstown Sheet and Tube Company, Youngstown, Ohio

[22] Filed: Dec. 18, 1972

[21] Appl. No.: 316,294

[52] U.S. Cl. ..... 75/60; 75/44 S; 75/46

[51] Int. Cl.[2] ..... C21C 7/00

[58] Field of Search ..... 75/46, 60, 43, 44 R, 75/44 S

[56] References Cited

UNITED STATES PATENTS

| | | | |
|---|---|---|---|
| 1,939,874 | 12/1933 | Brassert | 75/46 |
| 2,593,505 | 4/1952 | Wagstaff | 75/60 |
| 2,790,711 | 4/1957 | Sellers et al. | 75/41 |
| 2,875,037 | 2/1959 | Wright | 75/60 |
| 2,886,304 | 5/1959 | Guthrie | 75/46 |
| 3,115,405 | 12/1963 | Boyd | 75/60 |
| 3,231,369 | 1/1966 | Gorlich et al. | 75/46 X |
| 3,248,211 | 4/1966 | Klein et al. | 75/60 |
| 3,301,662 | 1/1967 | Ban | 75/60 |
| 3,323,907 | 6/1967 | Kurzinski | 75/52 |
| 3,424,573 | 1/1969 | de Villiers | 75/43 |
| 3,753,688 | 8/1973 | Cherny et al. | 75/43 |

FOREIGN PATENTS OR APPLICATIONS

| | | | |
|---|---|---|---|
| 478,951 | 1/1938 | United Kingdom | 75/46 |
| 888,763 | 2/1962 | United Kingdom | 75/60 |

*Primary Examiner*—M. J. Andrews
*Attorney, Agent, or Firm*—John Stelmah

[57] ABSTRACT

Process for producing refined steel including the provision of molten iron, adding molten steel to said molten iron to provide a molten mix, adding iron bearing material in unmolten form to said mix, and refining the mixture by blowing essentially pure oxygen therethrough.

4 Claims, 1 Drawing Figure

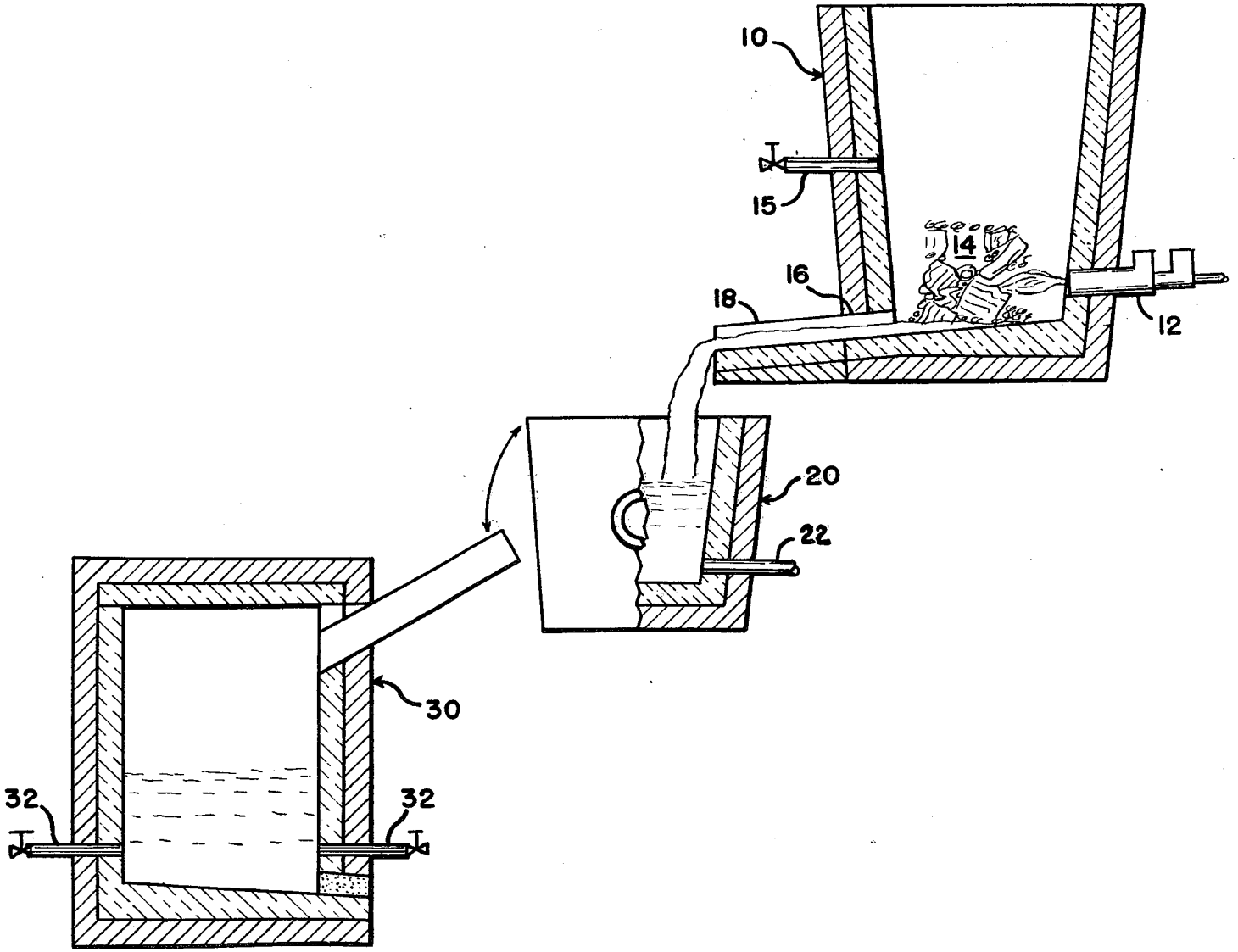
10
12
14
15
16
18
20
22
30
32
32

STEELMAKING PROCESS

CROSS-REFERENCES TO RELATED APPLICATIONS

Ser. No. 307,125, Method and Apparatus for Melting Iron Bearing Material; Applicants: Frank A. Nemec, et al; filed Nov. 16, 1972, now abandoned.

Ser. No. 307,130, Method and Apparatus for Continous Melting and Further Refining of Solid Material Bearing Iron; Applicants: Frank A. Nemec, et al; filed Nov. 16, 1972, now abandoned.

Both applications are assigned to the same assignee as the present application.

BACKGROUND OF THE INVENTION

In application Ser. No. 307,125, now abandoned there is disclosed method and means for melting solid materials bearing iron, such as scrap metal, with a flame produced by the combustion of a fuel and essentially pure oxygen. It has been found that the resultant product is of a steel making composition having a very low carbon content and is often highly oxidized. There is also disclosed method and means for adding reagents to the melt as it is discharged from the melter into a collection vessel.

In application Ser. No. 307,130, now abandoned there is disclosed method and means for melting solid materials bearing iron with an oxy-fuel flame and for continuous feeding of the melt to the receiving vessel of further refining means.

It is a purpose of the present invention to improve the efficiency of the above disclosed processes and to provide improved methods for controlling the oxygen and carbon contents of the melt from the oxy-fuel flame melter.

This invention relates generally to a process for melting of iron or steel bearing material in which melting the charge may be partly or entirely scrap metal; the melt is then further treated in a number of different steps in a number of different apparatus having different functions.

More specifically, this invention relates to a process for melting iron bearing material; adding the melt to another molten composition to modify the carbon content of the composition; and further refining the resultant mix with oxygen.

The objects of this invention are attainable through the provision of method and means for oxy-fuel melting a charge of solid material, bearing iron, which melting produces a relatively low carbon containing composition; the low carbon composition is added to another molten composition of relatively higher carbon content, such as that produced by conventional blast furnace practice, to provide a molten mix; unmolten iron bearing material is added to said molten mix in a refining vessel having means for introducing essentially pure oxygen beneath the surface of the melt in said refining vessel.

DESCRIPTION OF THE DRAWING

The single FIGURE in the drawing is a schematic representation of the melting, mixing, and refining vessels used in conducting the basic steps comprising the process of this invention.

DESCRIPTION OF PREFERRED EMBODIMENTS

In application Ser. No. 307,125, now abandoned referred to above, there is disclosed method and means of the type which may be employed in the process of this invention for melting solid materials bearing iron, e.g. scrap metal. Such disclosure is incorporated by reference in this application. However, for convenience the melting apparatus there shown is schematically illustrated in the drawing of this application and is generally designated by the numeral 10. However, the illustration of the melting apparatus has been modified to show means for providing combustion supporting gas, which means will hereinafter be described.

In a preferred embodiment, a plurality of oxy-fuel burners 12 are disposed about the melting vessel 10 and positioned to direct their flames at a bottom portion of the feed charge column 14. As portions of the bottom of column 14 are rendered molten, the melt flows toward and through a tap hole 16. Optionally, auxiliary heat may be directed at the tap hole 16 to deter "freezing" of the metal. Trough 18 is provided to direct the melt to positionable mixing vessel 20. The melting of the solid charge with oxy-fuel produces a melt which is of very low carbon content, generally less than 0.1%, and which is highly oxidized. For the purpose of definition in this patent application, a "low carbon" containing composition is considered to be one having less than 2% carbon, and a "high carbon" containing composition is one which includes at least 2% carbon. All % composition figures herein given are "by weight".

Preferably, the low carbon composition melt from the melter 10 is directed to a mixing vessel 20 into which a high carbon molten composition has been previously charged. Suitably, the high carbon melt may be blast furnace iron at a temperature generally around 2400° – 2500° F and having a typical composition comprising, by weight: 0.5 – 2.0% silicon; at least 2% carbon; 0.40 – 1.5% manganese; and the balance being essentially iron. In a more preferred embodiment, the high carbon molten composition comprises: about 1% silicon, about 4% carbon, 0.5 – 1.0% manganese; and the balance essentally iron. Also preferably, a composite molten mix is provided which is comprised of 40 – 75% low carbon composition and 60 – 25% of the high carbon composition. The mix will usually result in a composition being at a temperature of about 2600° F and comprising: 0.5 – 0.6% silicon; 1.8 – 2.0 carbon; 0.3 – 0.4 manganese; and the balance essentially iron.

It is also preferred to provide agitating means for the mixing vessel 20 for stirring and enhancing intermixing of the "low carbon" and "high carbon" compositions. Such agitating means may be in any suitable form, mechanical, electrical, or by injection of a gaseous stream discharged below the surface of the molten mix through separate tuyeres 22.

By the addition of the low carbon composition from the melter to the high carbon composition (blast furnace iron) and the refinement of the resultant mix, it is expected that any oxidized metal from the melter will be reduced by the carbon in the high carbon composition.

The molten composite mix metal is preferably charged, for ease in processing, to a separate refining vessel. However, it will be understood that the further refinement may be conducted in the same vessel, where the mixing of the low carbon and the high carbon compositions takes place, through the provision of suitable means for introducing the refining medium.

The separate refining vessel, referred to above, is designated by the numeral 30 and is illustrated to be generally in the form of an open hearth type furnace; however, modified to omit the usual burners and/or oxygen lances employed in the typical open hearths. Instead, one or more tuyeres 32 are provided as refinement medium means for introducing a refining gas, such as essentially pure oxygen (at least 80%), beneath the surface of, into, and for refinement of the molten metal bath mix charged from mixing vessel 20.

Alternatively, the refinement medium means may be incorporated in those refining vessels commonly referred to as "bottom" blown converters or to "side" blown converters. As another alternative, as indicated above, the refinement medium means may be incorporated into the mixing vessel 20. It will be apparent from this disclosure that a single mixing vessel may be used to service more than one refining vessel.

In a typical and preferred process, sufficient molten mix metal is provided to the vessel, where refining is to take place without the addition of more heat, to constitute approximately 85 – 95% of the total anticipated work charge. The approximately remaining 5 – 15% of the charge may be advantageously comprised of cold unmolten scrap, and/or iron ore pellets, and/or other iron bearing materials in solid form. After the charge is completed, refining is conducted by introducing substantially pure oxygen beneath the surface and blowing through the molten charge. Of course, if additional heat is provided, such as by burners in the refining vessel, then the amount of unmolten scrap may be increased.

It will be noted that the total "hot metal" (relatively high carbon content composition) imput to the refining vessel is in the order of 22 – 54%,i.e., 25 to 60% total charge to mixing vessel × 90% total charge to refining vessel. In contrast, conventional open hearth and BOF practices utilize 55 – 60% and 70% "hot metal", respectively.

It is also anticipated that higher yields of usable steel are attainable through the use of the introduction of the refining medium below the surface of the molten bath, as opposed to blowing unto the surface. One of the contributing factors is better utilization of the refining medium attained by virtue of the more intimate contact with the bath. Another factor is that there is less iron oxide emission loss than that encountered with the use of oxygen lances and the resultant fuming.

The process of this invention provides several advantages in steel refinement as compared with conventional steelmaking practices. Some of these advantages are:

1. Improved yields of usable steel;
2. Unprepared scrap may be used;
3. No additional heat imput required in the refining vessel or furnace;
4. The refining furnace charge may be comprised of as little as 22 – 54% hot metal (relatively high carbon content, e.g. blast furnace iron), in contrast, 55 – 60% hot metal is required in conventional open hearth practice and 70% is required in conventional BOF practice;
5. Faster refining times are attainable through the introduction of refining oxygen beneath the surface and through the molten bath, i.e., the rate of oxygen that can be introduced is not limited to the extent as in the case of vertically supported oxygen lances in conventional open hearths;
6. Higher fuel efficiencies are attainable, i.e., 70% or better, compared with usual 15% in open hearth;
7. Improved vessel roof life because of reduced dust emissions and decreased fuel consumption;
8. Flexibility of batch sizes which can be produced in refining vessel; and
9. Ease of process control through selectable adjustment of oxygen injection in scrap melter and/or refining vessel.

The present invention provides an additional improvement in the melting practice as disclosed in application Ser. No. 307,125, now abandoned. In the melter of this invention, the burners are operated to provide a reducing flame, i.e., less oxygen is supplied directly to the burners than that required to provide a stoichometric mixture. Such operation minimizes oxidation of the molten charge produced in the melter. Also, supplementary combustion supporting gas supply means, illustrated in the form of nozzle 15, is provided. Air, oxygen enriched air, or additional essentially pure oxygen is introduced through the nozzle means 15, positioned at an elevated position in relation to the burner 12 and the work charge column 14. The provision of such supplementary combustion supporting gas facilitates "burning" of the carbon monoxide, produced by the reducing flame of burner 12, and conversion to carbon dioxide for optimum fuel efficiency.

What is claimed is:

1. A process for producing refined steel which comprises:

a. providing a supply of molten iron bearing material, having a composition comprising, in percent by weight:

| | |
|---|---|
| .5 – 2.0 | Silicon |
| 2.0 min. | Carbon |
| .4 – 1.5 | Manganese |

and the balance being essentially iron b. adding, to said molten iron, molten steel having a carbon content less than 2%, by weight, to provide a molten mix comprising 40–75% molten steel and 60–25% molten iron;

c. adding, to said molten mix, unmolten iron bearing material in an amount where the unmolten material comprises approximately 5–15%, by weight, of the resultant mixture comprised of said molten mix and the added unmolten material; and d. blowing essentially pure oxygen through the resultant mixture to refine the same.

2. A process, as described in claim 1, wherein:

the molten steel added in step (b) is steel melted from scrap metal by oxy-fuel flame.

3. A process for producing refined steel, comprising:

a. providing a supply of molten iron bearing material at a temperature of about 2400° – 2500° F and having a carbon content of at least 2% by weight;

b. adding to said molten iron, molten steel having a carbon content less than 2%, by weight, to provide a molten mix comprising 40–75% molten steel and 60–25% molten iron, at a temperature of about 2600° F;

c. adding, to said molten mix, unmolten iron bearing material in an amount where the unmolten material comprises approximately 5–15%, by weight, of the resultant mixture comprised of said molten mix and the added unmolten material; and d. refining said resultant mixture by injecting essentially pure oxygen into the molten mix.

4. A process for the refining of steel-making compositions, which comprises:

a. providing a supply of molten iron at a temperature of about 2400°F and having a composition comprising, in percent by weight:

| | |
|---|---|
| .5 – 2.0 | Silicon |
| 2.0 min. | Carbon |
| .4 – 1.5 | Manganese |

and the balance being essentially iron b. adding to said molten iron, low carbon molten steel scrap to provide a molten mixture being comprised of approximately 60% of said molten scrap and approximately 40% of said molten iron composition;

said mixture being at a temperature of about 2600°F and being of a composition comprising

| | |
|---|---|
| .5 – .6 | Silicon |
| 1.8 – 2.0 | Carbon |
| .3 – .4 | Manganese |

and the balance being essentially iron c. adding to said molten mixture unmolten iron bearing material in an amount where said unmolten iron bearing material comprises approximately 5–15% of the resultant mixture; and d. refining said resultant mixture by blowing oxygen therethrough with a nozzle having its discharge opening positioned beneath the surface of the molten charge.

* * * * *